US006321943B1

(12) United States Patent
Strickler et al.

(10) Patent No.: US 6,321,943 B1
(45) Date of Patent: Nov. 27, 2001

(54) SOAP DISPENSER FOR SOAP OF DIFFERENT VISCOSITY

(75) Inventors: Jeffrey E. Strickler, Dover, PA (US); John Kauzlarich, Darien, IL (US); Brian Phillips, Joliet, IL (US); A. J. Voth, St. Charles, IL (US)

(73) Assignee: Gent-I-Kleen Products, Inc., York, PA (US)

( * ) Notice: Subject to any disclaimer, the term of this patent is extended or adjusted under 35 U.S.C. 154(b) by 0 days.

(21) Appl. No.: 09/415,773

(22) Filed: Oct. 9, 1999

(51) Int. Cl.[7] ..... B67D 5/00

(52) U.S. Cl. ..... 222/82; 222/83.5; 222/156; 222/181.3

(58) Field of Search ..... 222/81, 82, 83, 222/83.5, 88, 156, 181.3, 383.1

(56) References Cited

U.S. PATENT DOCUMENTS

| | | | | |
|---|---|---|---|---|
| D. 278,887 | | 5/1985 | Steiner | D9/403 |
| D. 282,347 | | 1/1986 | Steiner | D9/403 |
| D. 282,528 | | 2/1986 | Steiner | D9/403 |
| 4,149,573 | | 4/1979 | Cassia | 141/18 |
| 4,173,858 | | 11/1979 | Cassia | 53/471 |
| 4,429,812 | | 2/1984 | Steiner et al. | 222/181 |
| 4,673,109 | | 6/1987 | Cassia | 222/153 |
| 5,082,150 | | 1/1992 | Steiner et al. | 222/181 |
| 5,174,476 | | 12/1992 | Steiner et al. | 222/181 |
| 5,265,772 | * | 11/1993 | Bartasevich et al. | 222/156 |
| 5,356,046 | * | 10/1994 | Burke | 222/156 |
| 5,482,176 | * | 1/1996 | Maietta et al. | 222/83 |
| 5,732,853 | * | 3/1998 | Ganzeboom et al. | 222/181.3 |
| 5,791,525 | * | 8/1998 | Fan | 222/181.3 |

* cited by examiner

*Primary Examiner*—Joseph A. Kaufman
(74) *Attorney, Agent, or Firm*—Emrich & Dithmar

(57) ABSTRACT

A system of dispensing viscous liquid including mounting plate and reservoir and dispensing mechanism for use with a bottle containing liquid having a viscosity up to about 20,000 cps. The mounting plate has a generally flat rectangular surface with a first and second pair of vertically extending mounting tracks extending outwardly from the plate. A first shelf positioned generally horizontally and extending from the plate below and between the first pair of tracks. A second shelf positioned generally horizontally and extending outwardly of the plate generally below and between the second pair of tracks. A flexible first latch positioned between the first shelf and the second pair of tracks, and a mechanism below the second shelf for supporting the mechanism for dispensing liquid. A bottle has a neck with a membrane capable of being punctured, and a dove tail member extending longitudinally of the bottle spaced to slide between at least one of the first and second pair of mounting tracks. The reservoir has a housing with one end for receiving the bottle of liquid and an opening at the other end through which liquid flows, and the housing has a punch extending upwardly and positioned to extend into the bottle neck and to puncture the membrane. The reservoir and variations of the plate are disclosed as are bottle variations and a different pumping mechanism.

16 Claims, 17 Drawing Sheets

SOAP DISPENSER FOR SOAP OF DIFFERENT VISCOSITY

RELATED APPLICATIONS

This application is based on provisional patent application no. 60/108,969, filed Nov. 18, 1998, in the name of Jeffrey Strickler.

BACKGROUND OF THE INVENTION

This invention relates to a system for dispensing soap with a wide range of viscosities. Although the invention may be used to dispense a wide variety of viscous material, soap will be used for only illustrative purposes. Normally, soap is dispensed in commercial systems wherein the soap has a relatively low viscosity on the order of 1000 to 2000 cps. The present invention is directed toward a system which can accommodate the lower viscosity soaps normally encountered in commercial establishments such as restaurants, washrooms, airports, and the like, as well as grit containing soaps in which the viscosities may be as high as 20,000 cps.

Patents which are relevant to the lower viscosity dispensing systems, for instance, include but are not limited to U.S. Pat. Nos. Des. 248,927, Des. 278,887,Des. 282,347, Des. 282,528, Des. 299,427, Des. 325,312, Des. 332,544, 4,149, 573 , 4,173,858, 4,214,676, 4,316,555, 4,391.308, 4,391, 309, 4,429,812, 4,673,109 , 4,886,192, 5,082,150, 5,174, 476, 5,209,377, 4,345,627, and 4,576,313.

On the other hand, when viscosities increase, systems such as those disclosed in the patents above are often insufficient to dispense the higher viscosity material. Frequently, higher viscosity materials on the order of 15,000–20,000 cps viscosities simply do not flow through the systems used to dispense soaps having viscosities in the 1000–2000 cps range. Accordingly, this invention is directed to a new system which can accommodate soaps having a wide range of viscosities.

SUMMARY OF THE INVENTION

Accordingly, it is an object of the invention to provide a commercial device including mounting plates, dispensing mechanisms, reservoirs and soap cartridges which can accommodate a wide range of fluid materials having various viscosities.

Yet another object of the present invention is to provide a device in which a high viscosity liquid can be dispensed in doses using a standard dispensing mechanism.

Yet another object of the present invention is to provide a combination of a soap cartridge and a punch or cutting mechanism which permits high viscosity soap to be dispensed while at the same time retaining the sealing material used to seal the soap cartridge attached to the soap cartridge so as to prevent inadvertent plugging of the dispensing mechanism.

Another object of the present invention is to provide a series of mounting plates useful for mounting a variety of combinations of the various constituent parts of the liquid dispensing system.

A still further object of the present invention is to incorporate a new soap container or bottle which can be mated to a backing or mounting plate so as to provide a commercially secure system.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
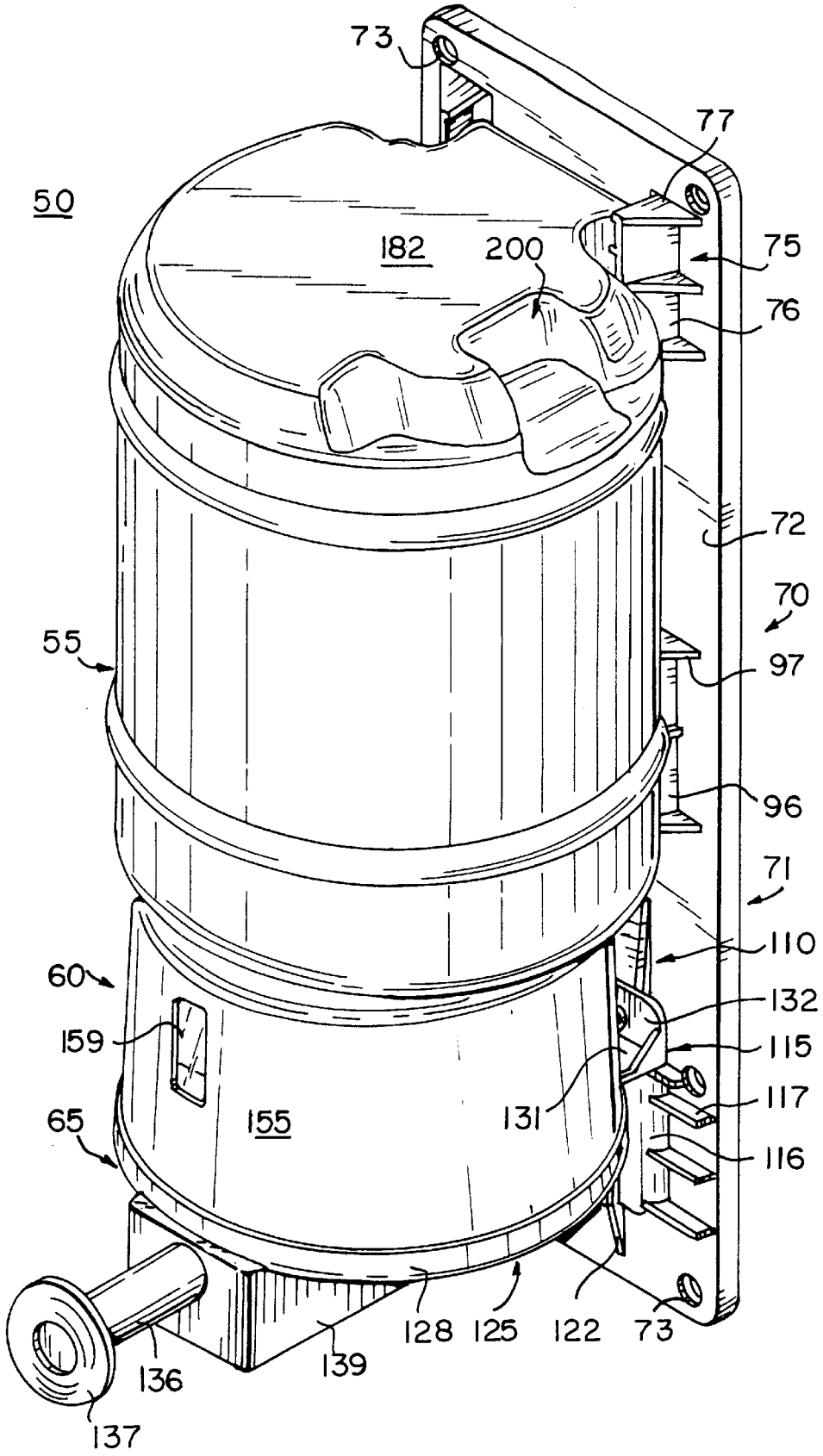
FIG. 1 is a perspective view of one embodiment of the mounting plate, dispensing system, reservoir system and soap container of the present invention.

Referring now to the drawings and particularly to FIGS. 1 through 9 thereof, there is illustrated a soap dispensing system 50 which includes a soap bottle or container 55 sitting on top of a reservoir 60 which is received by a dispensing mechanism 65, all of which are supported by a support plate 70. Various plate configurations are disclosed hereinafter which support various combinations of the components described above.

Figure 4:
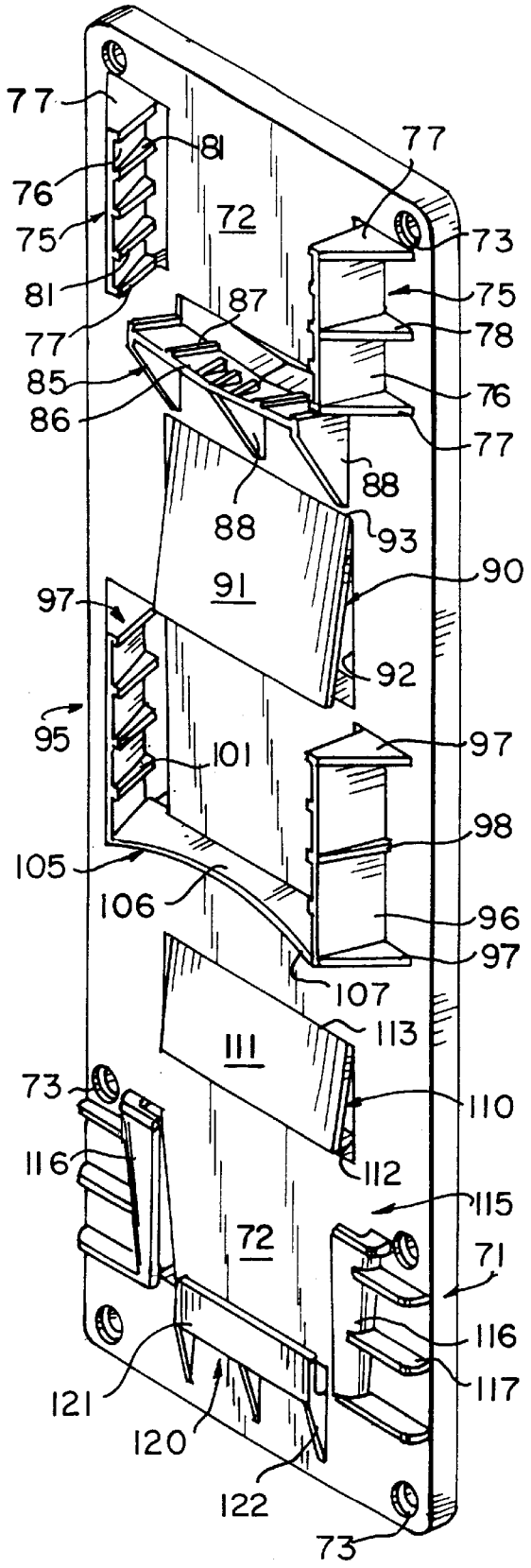
FIG. 4 is a perspective view of the support plate used in the system illustrated in FIG. 1.
Figure 5:
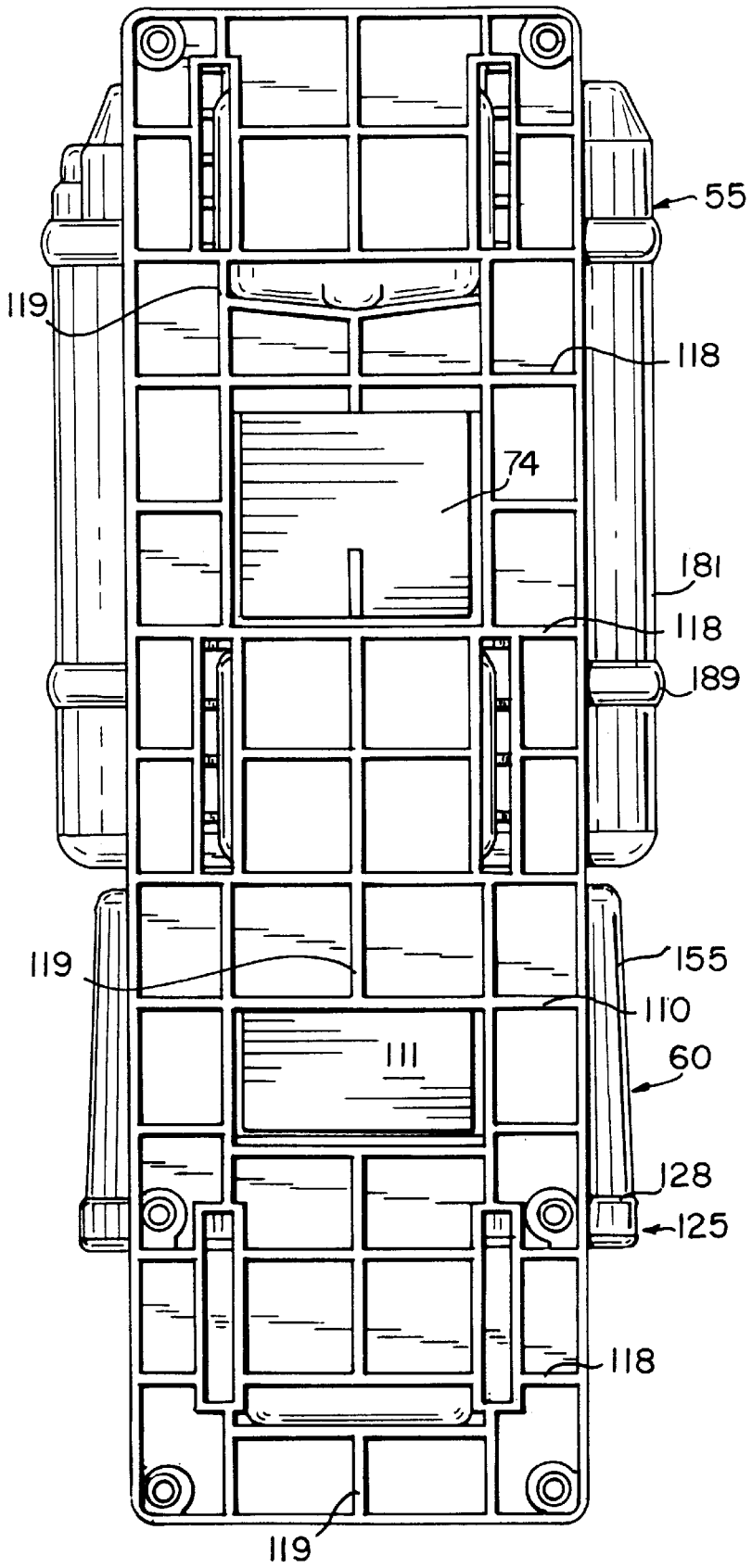
FIG. 5 is a rear elevational view of the soap dispensing system illustrated in FIG. 1.
Figure 6:
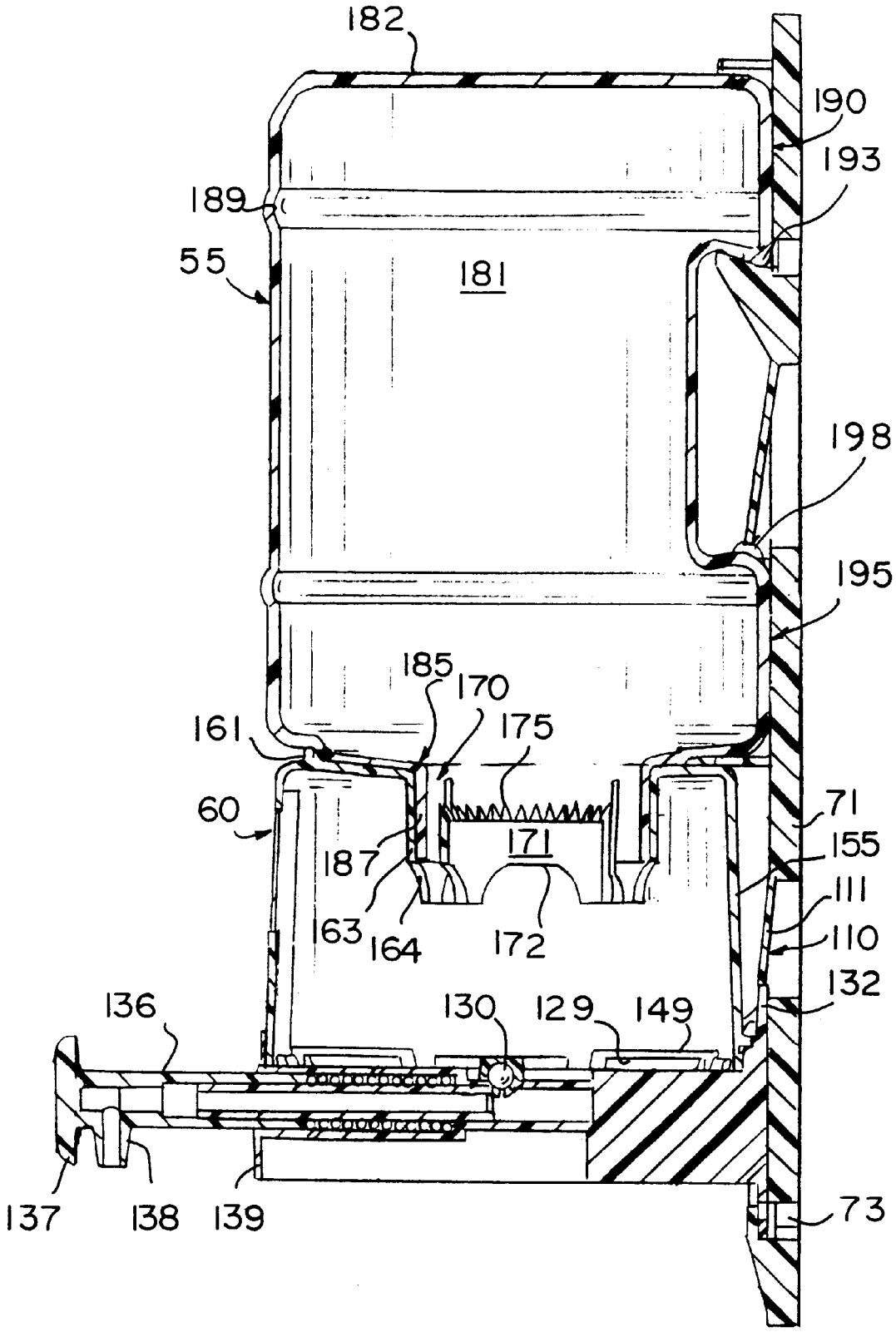
FIG. 6 is a view in cross section of the system illustrated in FIG. 2 as seen along lines 6—6 thereof.

More particularly, as best seen in FIGS. 1, 4 and 5, the support plate 70 includes a generally rectangular member 71 having a front surface 72 and a rear surface 74 and having a plurality of mounting apertures 73 therein. Preferably, the mounting apertures 73 are at each ends of the plate 71 and also longitudinally spaced from but near the bottom of the plate 71.

A first pair of mounting rails 75 are positioned near the top of the support plate 70 and each includes an inwardly directed, generally rectangular plate 76 having top and bottom triangularly shaped end ribs 77 and a intermediate triangularly reinforcing member 78. There are two mounting rails 75, one the mirror image of the other to make up the first pair of mounting rails. A plurality of strengthening ribs 81 on the inwardly facing surfaces of the plate 76 help to stabilize the first pair of mounting rails 75.

Figure 17:
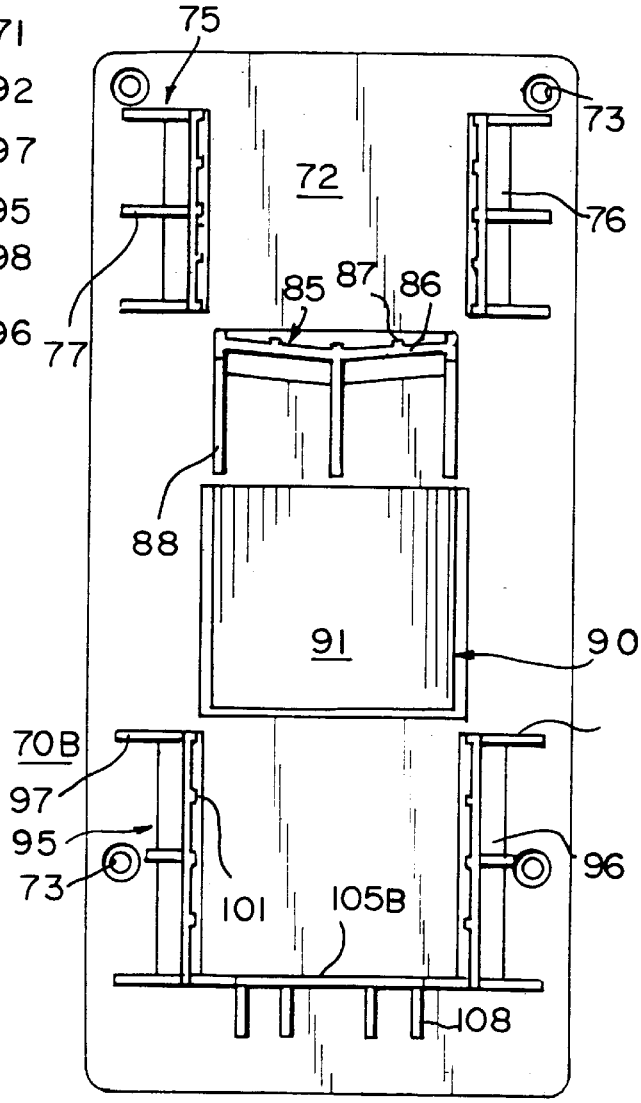
FIG. 17 is a front elevational view of the support plate illustrated in FIG. 16.

Below the first pair of mounting rails 75 and intermediate the rails is a first or upper shelf 85 which includes a platform 86 which extends somewhat downwardly from the edges of the platform toward the middle, as best seen in FIG. 17, as will be explained later, the platform 86 being provided with a plurality of outwardly extending ribs 87 and a number of triangular supports 88, there being three shown.

An upper latch 90 extends outwardly from the surface 72 of the plate 70 and includes a generally rectangular or square flap 91 extending outwardly from an opening 92 in the plate 70 and being connected to the plate by a hinge 93.

Figure 19:
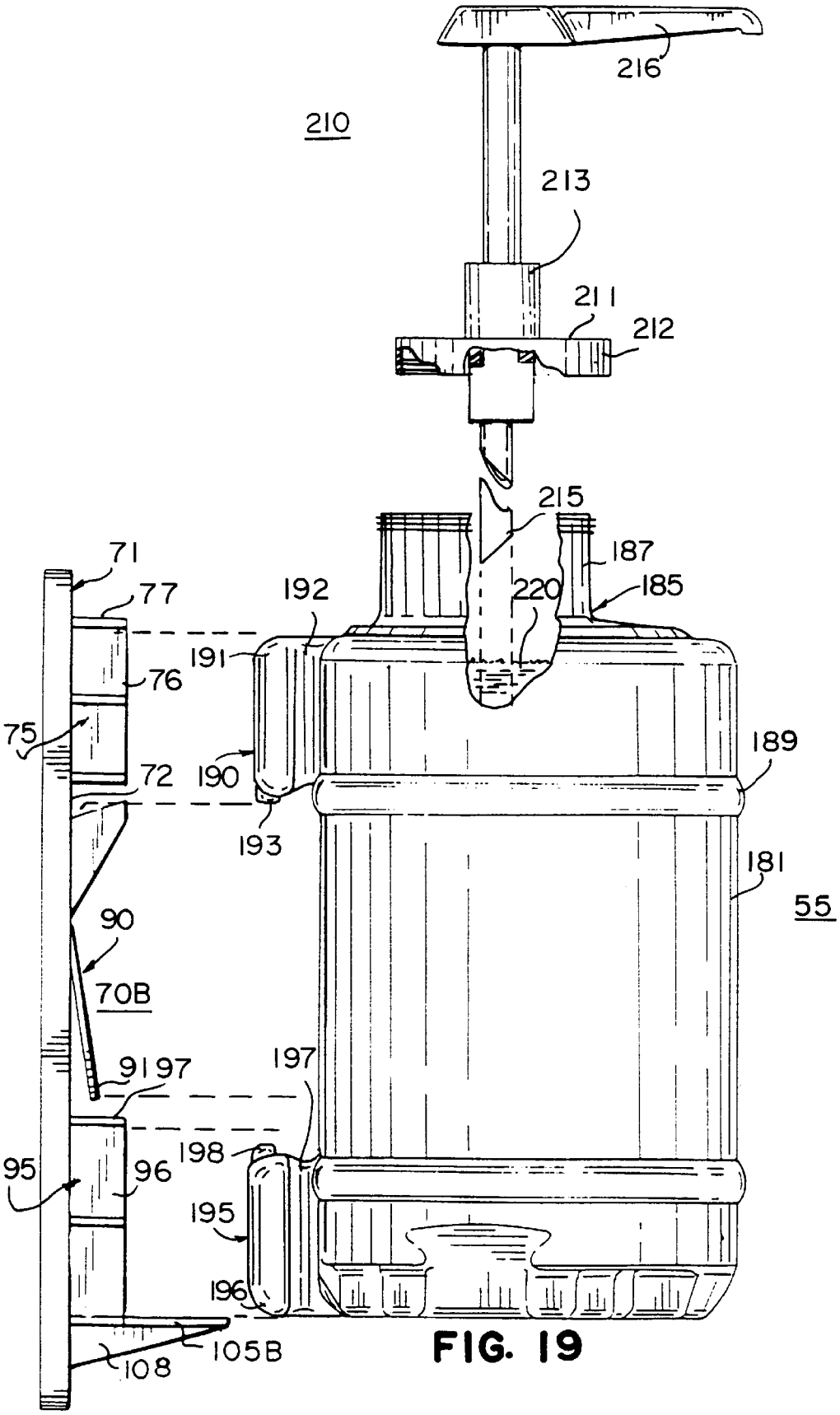
FIG. 19 is a side view partly in section of the soap dispenser and mounting plate shown in FIG. 18 in exploded view.
Figure 20:
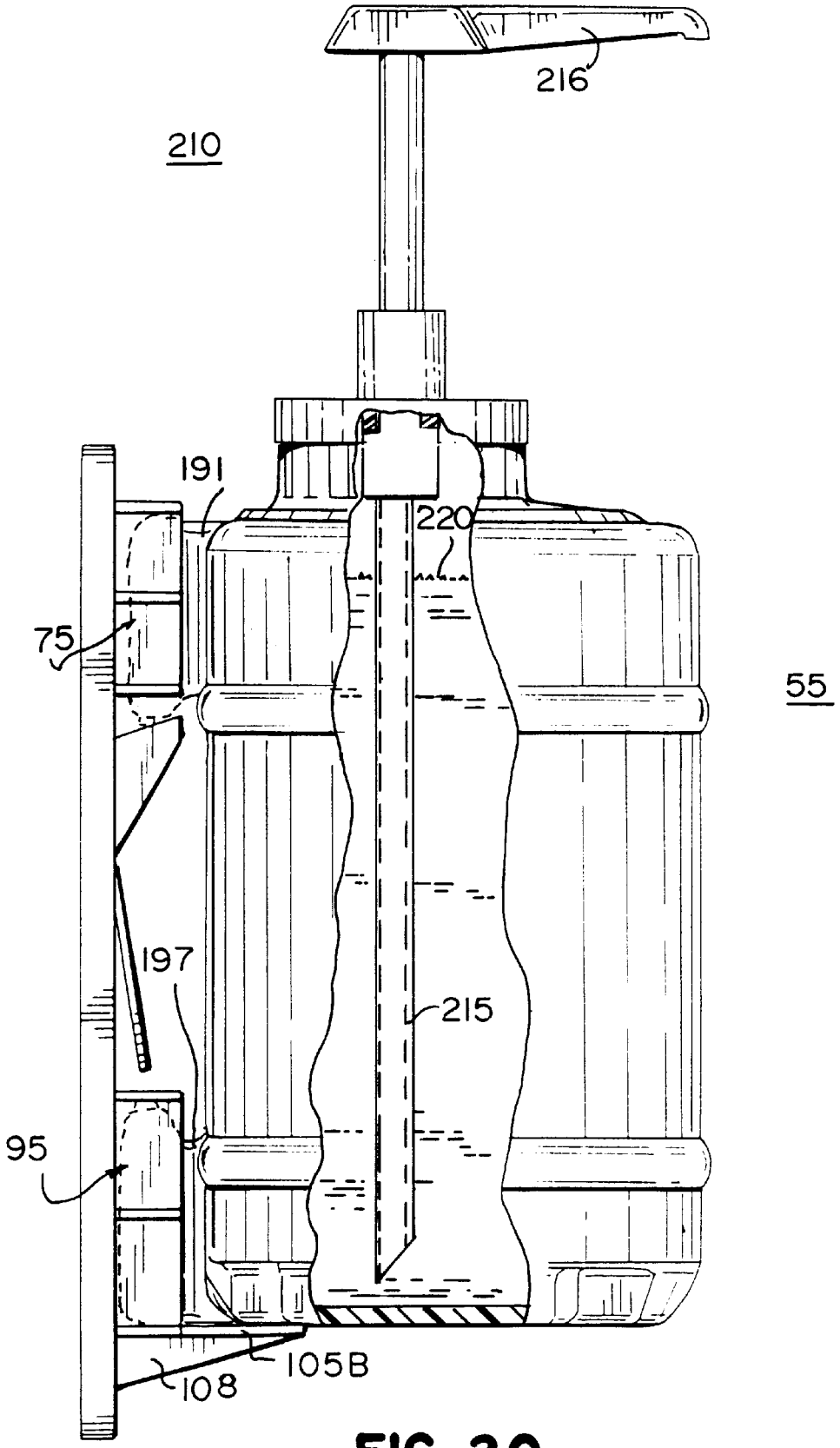
FIG. 20 is a view in partial section and partial elevation of the soap dispenser illustrated in FIG. 18.

Below the upper latch 90 is a second pair or lower mounting rails 95, each of which includes a generally flat rectangular plate 96 extending inwardly and outwardly from the plate 70 and more particularly the front surface 72 thereof being provided with end plates 97 similar to the end plates 77 previously described and a middle reinforcing member 98 similar to the previous reinforcing member 78 hereinbefore described. The inner sides of the plates 96 include a plurality of ribs 101. At the bottom of the second pair of mounting rails 95 is a second or lower shelf 105 which is a generally flat piece having an upper surface 106 and a curved arcuate outwardly facing edge 107. A plurality of support ribs 108 at the bottom of the shelf 105 are seen in FIGS. 17, 19 and 20.

There is further provided on the plate 70 a lower latch 110 consisting of a flap 111 generally rectangular in shape cut out from an opening 112 in the plate body 71 and connected thereto by a hinge 113. A receiving mechanism 115 for the dispenser mechanism 65 includes two generally vertically positioned and slightly taped toward each other and spaced apart L-shaped channels 116 each of which is strengthened by a plurality of generally horizontally extending ribs 117 and a support ledge 120 generally horizontally extending and having an L-shaped portion or channel 121 with a plurality of downwardly extending supports 122. The tapering of the channels 116 result in a wedging of the dispensing mechanism 65. The rear of the plate 70 is provided, as seen particularly in FIG. 5 with a plurality of horizontal and vertical ribs 118 and 119, respectively, for strengthening purposes.

While there has been described the preferred design of two pairs of rails (in a tongue and groove or dove tail arrangement, it is apparent to one of ordinary skill in this art that various configurations may be used to accomplish the purpose of this invention, and the preferred embodiment is descriptive, but not limiting.

Figure 9:
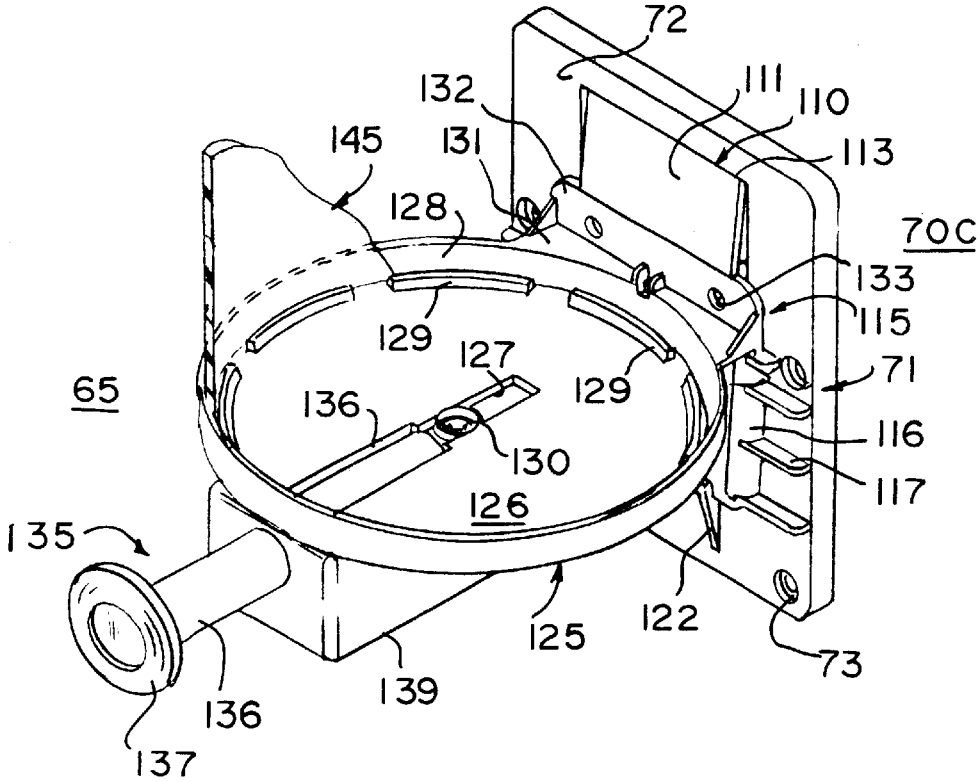
FIG. 9 is a fragmentary view of the dispensing mechanism used in the present invention illustrated in FIG. 1 on a mounting plate which is different than that illustrated in FIG. 1.
Figure 8:
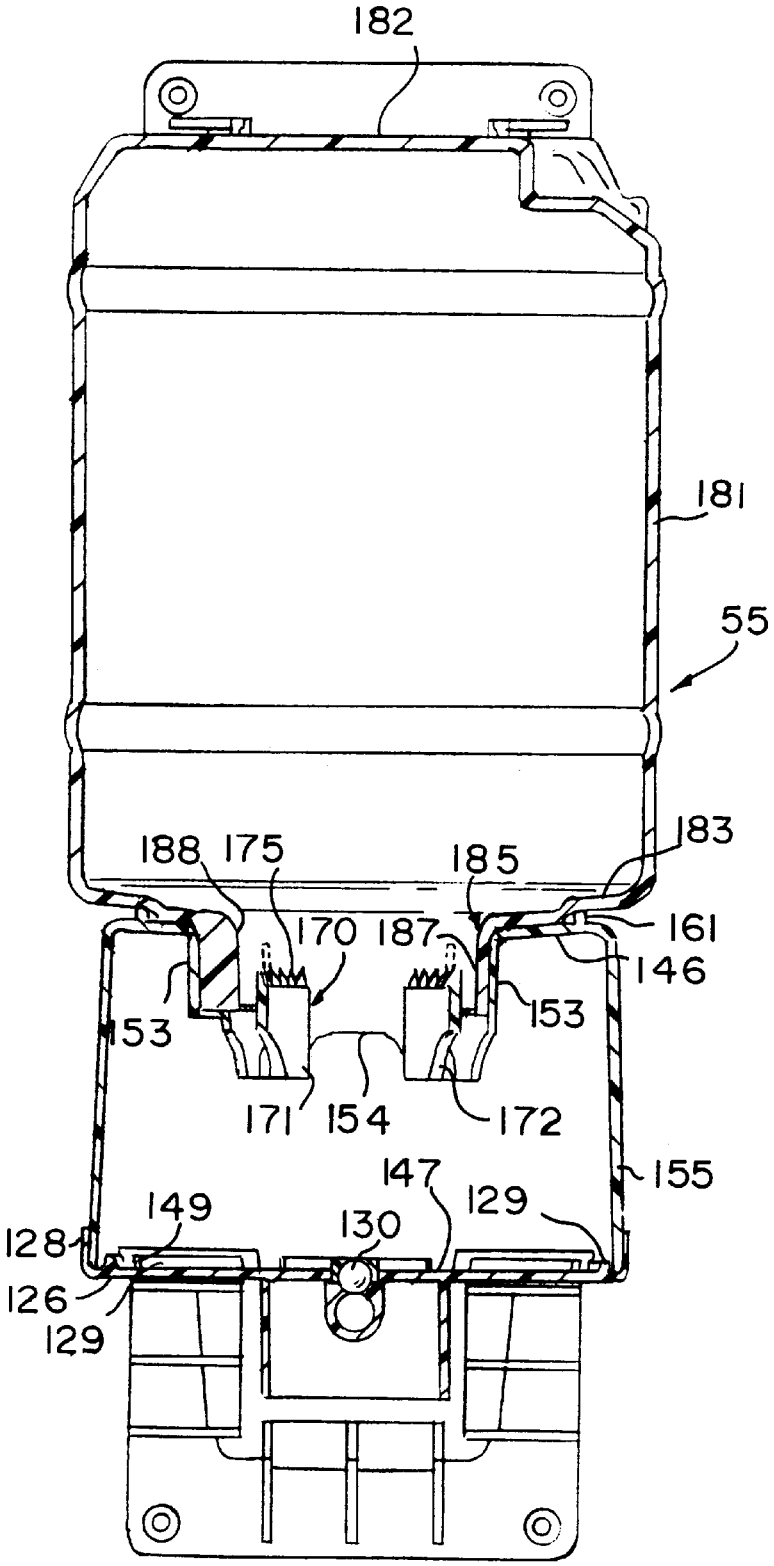
FIG. 8 is a view in cross section of the system illustrated in FIG. 3 as seen along lines 8—8 thereof.
Figure 10:
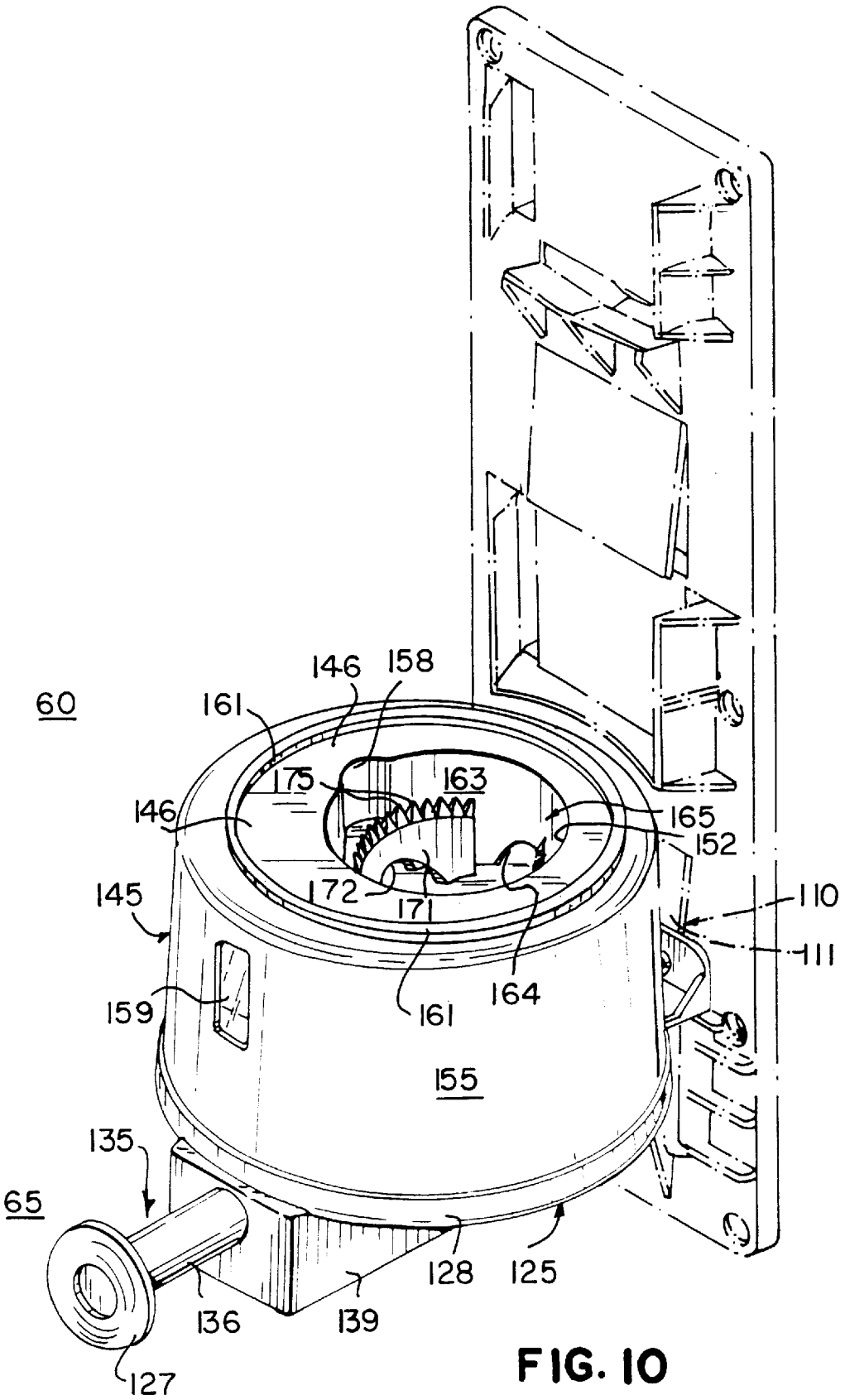
FIG. 10 is an enlarged perspective view of the reservoir and dispensing system illustrated in FIG. 1, showing the mounting plate in phantom line.
Figure 11:
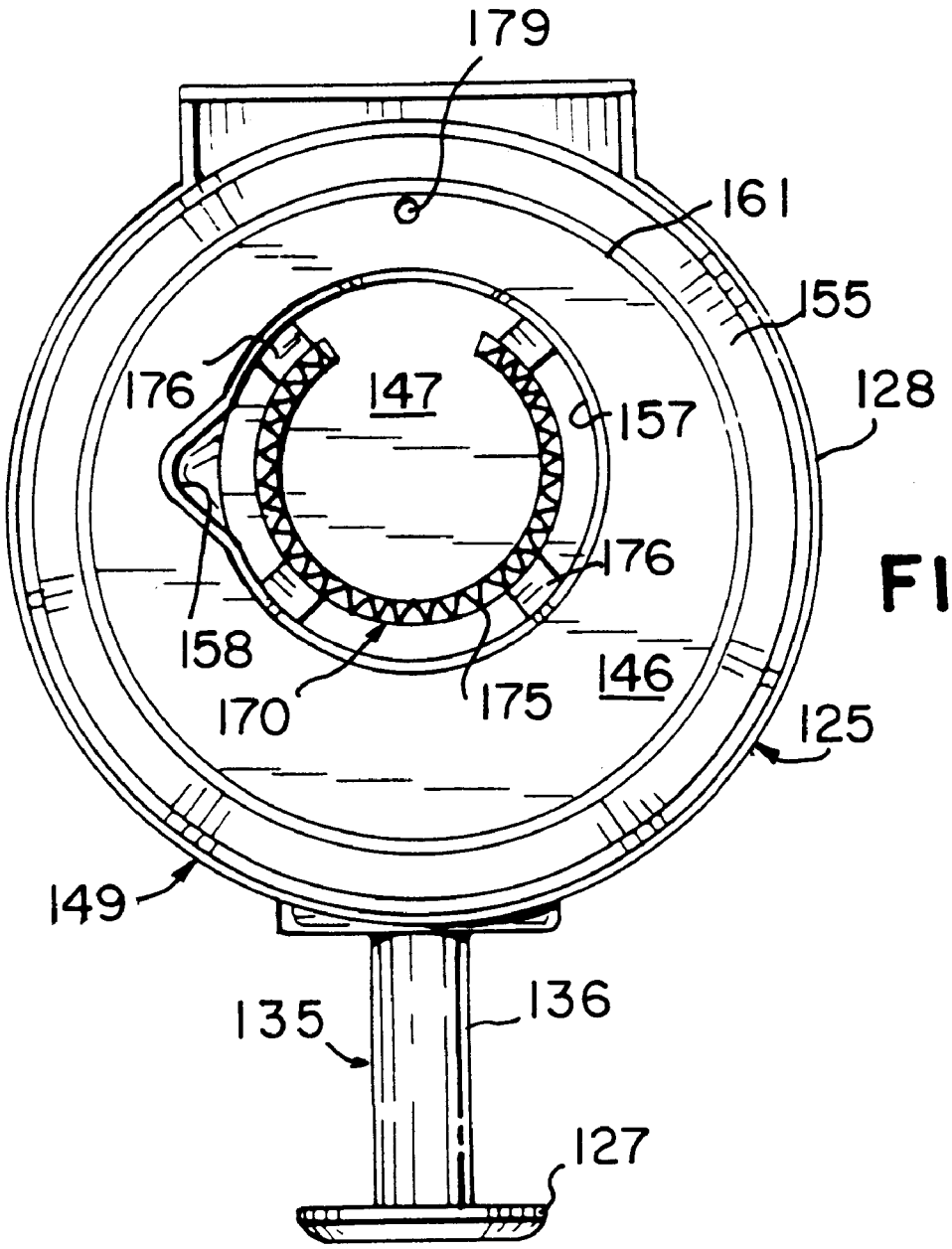
FIG. 11 is a top elevational view of the reservoir shown in FIG. 10.
Figure 12:
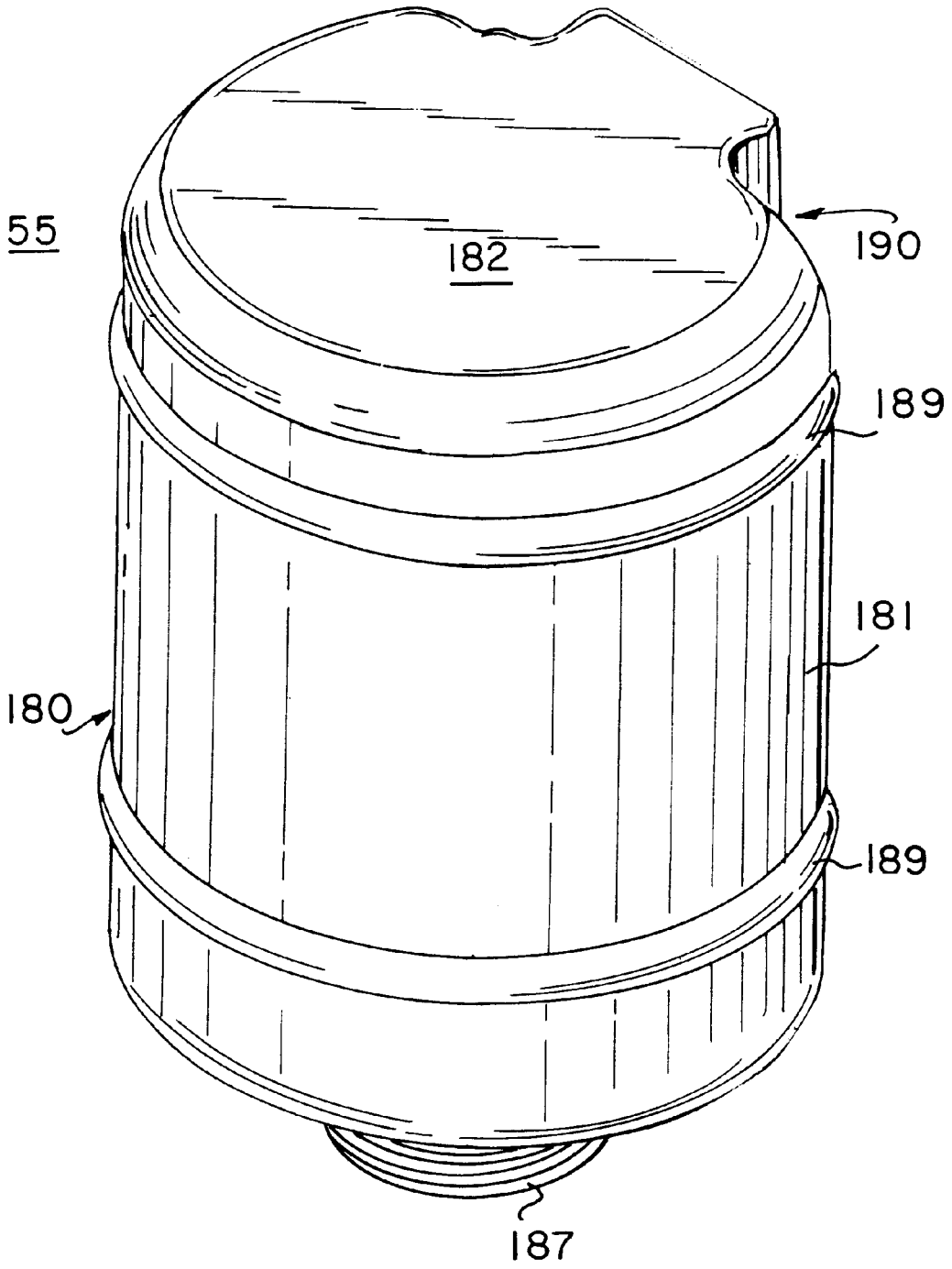
FIG. 12 is a perspective view of an alternate embodiment of the soap cartridge shown in FIG. 1.
Figure 13:
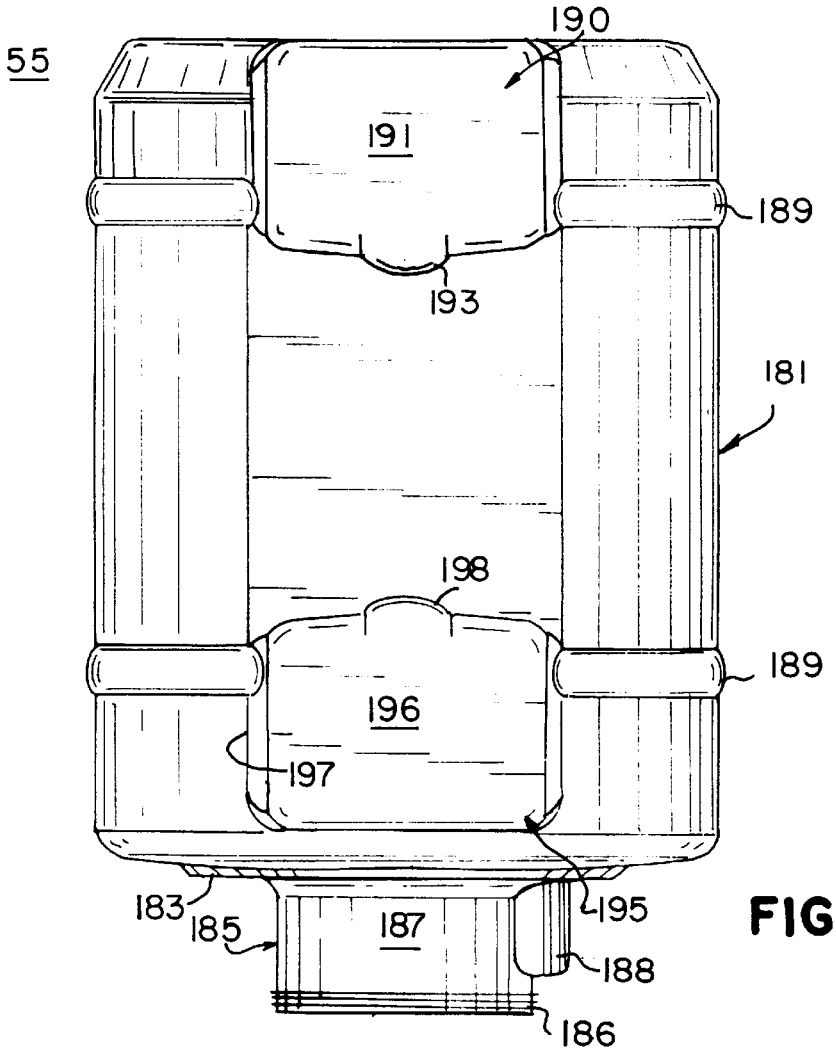
FIG. 13 is a rear elevational view of the soap cartridge illustrated in FIG. 12.
Figure 14:
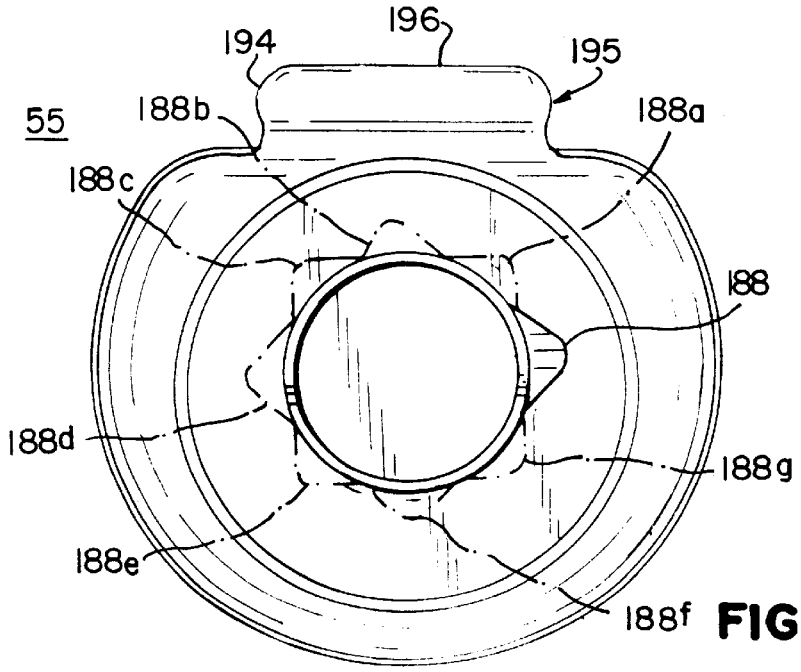
FIG. 14 is a bottom elevational view of the soap cartridge illustrated in FIG. 12.
Figure 15:
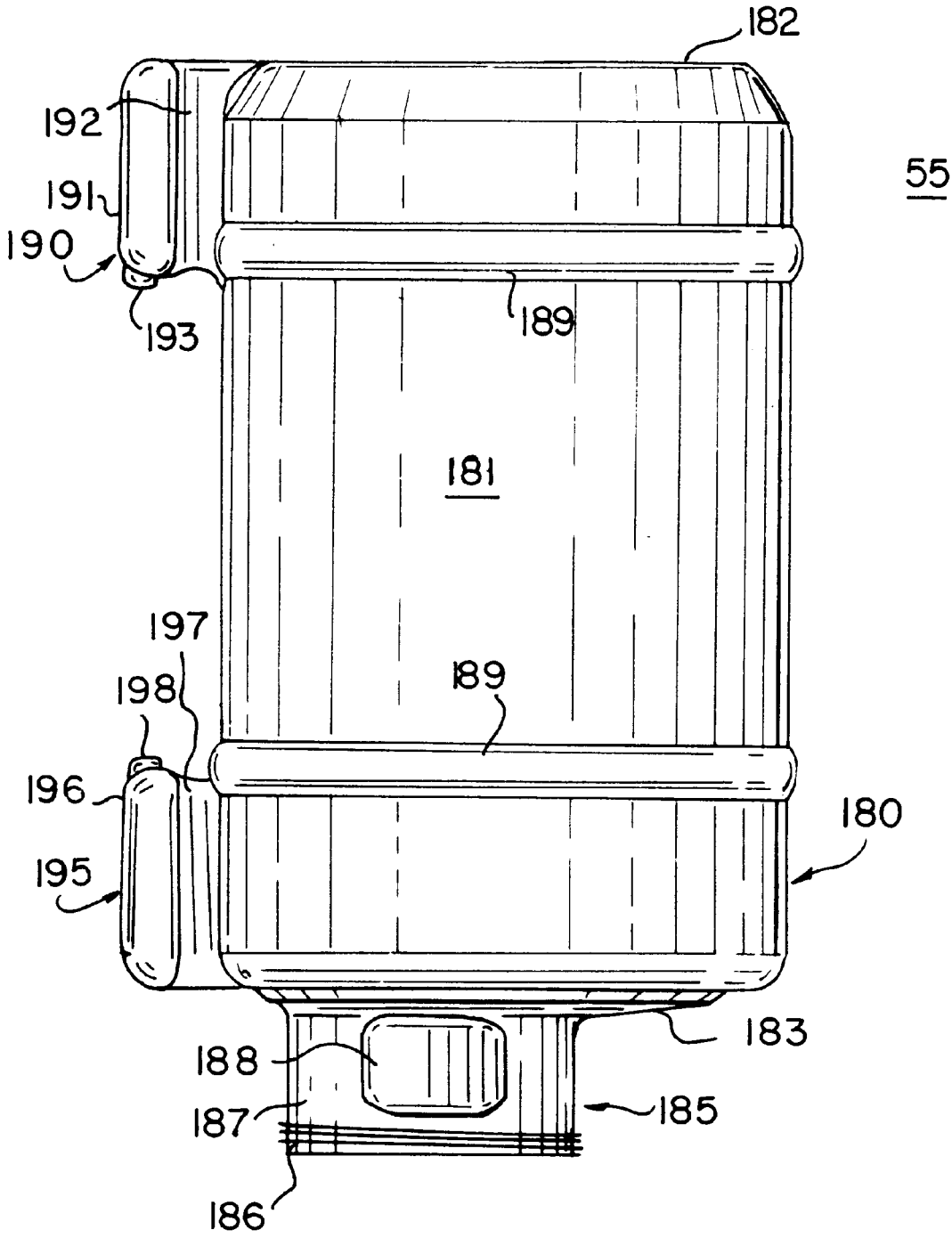
FIG. 15 is a side elevational view of the embodiment of the soap cartridge illustrated in FIG. 12.

The dispensing mechanism 65, as best seen in FIGS. 8 and 9, includes a dispensing mechanism support structure 125 which includes a flat circular plate 126 having a rectangular cut-out slot 127 therein and an upstanding peripheral ridge or flange 128. A plurality of circular segments 129 extend upwardly from the plate 126 for a purpose hereinafter set forth. A ball check valve 130 is positioned in the central circular cut-out contiguous with the slot 127.

Figure 7:
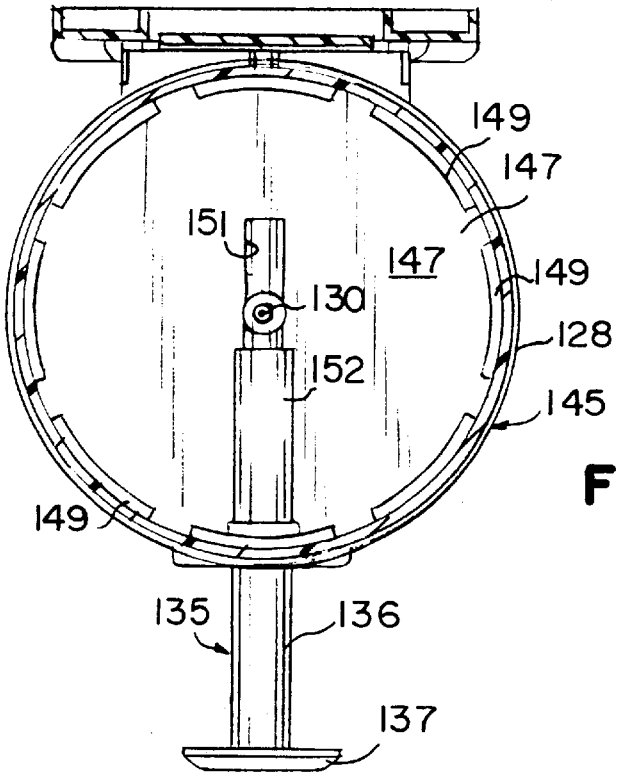
FIG. 7 is a view in cross section of the system illustrated in FIG. 2 as seen along lines 7—7 thereof.

Extending rearwardly and integrally with the dispensing mechanism support plate 125 is a horizontal ledge 131 having a vertical plate 132 provided with a plurality of mounting apertures 133. The vertical plate 132 extends downwardly and fits within the two opposed and tapered L-shaped side channels 116 so as to mount the dispensing mechanism 65 by wedging and centering action to the plate 70 as illustrated in FIG. 4 or to plate 70C as illustrated in FIG. 9. Plate 70C is substantially the same as the lower portion of the plate 70 previously described from a horizontal point just above the lower latch 110 to the bottom of the support plate. Like numbers have been used to identify like portions of the two plates 70 and 70C. An actuator mechanism 135 as best seen in FIGS. 7 through 9, includes a plunger housing 136 having a circular end cap 137 and a dispensing spout 138, seen in FIGS. 2 and 6. The actuator 135 further includes an actuator housing 139 which surrounds the slot 127 and the ball check valve 130 and provides support for the actuator 135, the dispensing mechanism 65 in general being old and well known in the art.

The reservoir 60, as best shown in FIGS. 6, 8, 10 and 11, has a frustoconical reservoir housing 145 having a flat upper surface 146 and a flat bottom surface 147. The flat bottom surface 147 is provided with a plurality of circular arcuate indentations 149 in the bottom thereof which fit over and frictionally fit upon the wedging segments 129 in the plate 126 of the dispensing mechanism support plate 125. As seen also in FIG. 7, there is a cut-out or rectangular slot 151 in registry with the slot 127 and a plunger cover 152 which prevents soap from caking on the plunger 135 and impeding the operation thereof. An outer wall 155 extends from the bottom 147 up to the top surface 146 defining an aperture 157 in the middle. A notch 158, which may identify a docking lug position, is cut into one side of the top wall 146 and may be located in one of eight different angular positions, for a purpose hereinafter set forth. The circular ledge 161 extends upwardly from the upper surface 146 to receive the bottle 55, as will be described. A window 159 is provided in the front of the side wall 155 to permit the operator the view the soap level in the reservoir 60 at any particular time.

A cylindrical skirt 163 extends downwardly from the top wall 146 and is provided with a plurality of circumferentially spaced apart notches or cut-outs 164 to facilitate soap flow, as will be explained. The skirt 163 defines a well 165 in which is positioned a C-shaped punch mechanism 170. The C-shaped punch mechanism 170 includes an upwardly extending cylindrical wall 171 also provided with a plurality of circumferentially spaced apart notches or cut-outs 172, also to facilitate flow of soap. The C-shaped punch 170 has an angular extent of not less than about 270° and preferably about 295° and is provided at the top end thereof with a plurality of serrated teeth 175. Connecting struts 176 (see FIG. 11) circumferentially spaced around the C-shaped punch 170 connect the cylindrical wall 171 to the skirt 163. Finally, a drain hole 179 is provided at the bottom of the surface 146 to facilitate cleaning of the reservoir structure 60. Although a C-shaped design is shown for punch 170, variations are acceptable, provided the seal for the bottle holding the liquid stays attached to the bottle after it is punched open.

Referring to FIGS. 12 through 15, there is shown a soap bottle body 180 similar to that disclosed in FIG. 1 and labeled 55. The soap bottle of FIG. 1 and the soap bottle of FIGS. 12 through 15 are principally the same and like numbers will be used to describe like portions. A bottle body 180 is generally cylindrical in shape and has a side wall 181 closed by a top wall 182 from the bottom wall 183 of the bottle 180 with the distal end of the neck 185 being in the form of plurality of ridges 186. In some circumstances, the ridges 186 may be threads, as will be described. The neck 185 includes a cylindrical portion 187 from which protrudes a lug 188 complimentary in shape to the notch 158 in the reservoir 60. As with the reservoir 60 and the notch 158 therein, the lug 188 may be positioned in eight various angularly disposed positions to accommodate systems which are proprietary to each purchaser. Moreover, a plurality of lugs and notches may be used to create more proprietary systems; and the lugs and notches may be reversed with the notch bottle neck. Finally, longitudinally spaced apart cylindrical bands 189 serve to rigidify the bottle 180.

Figure 2:
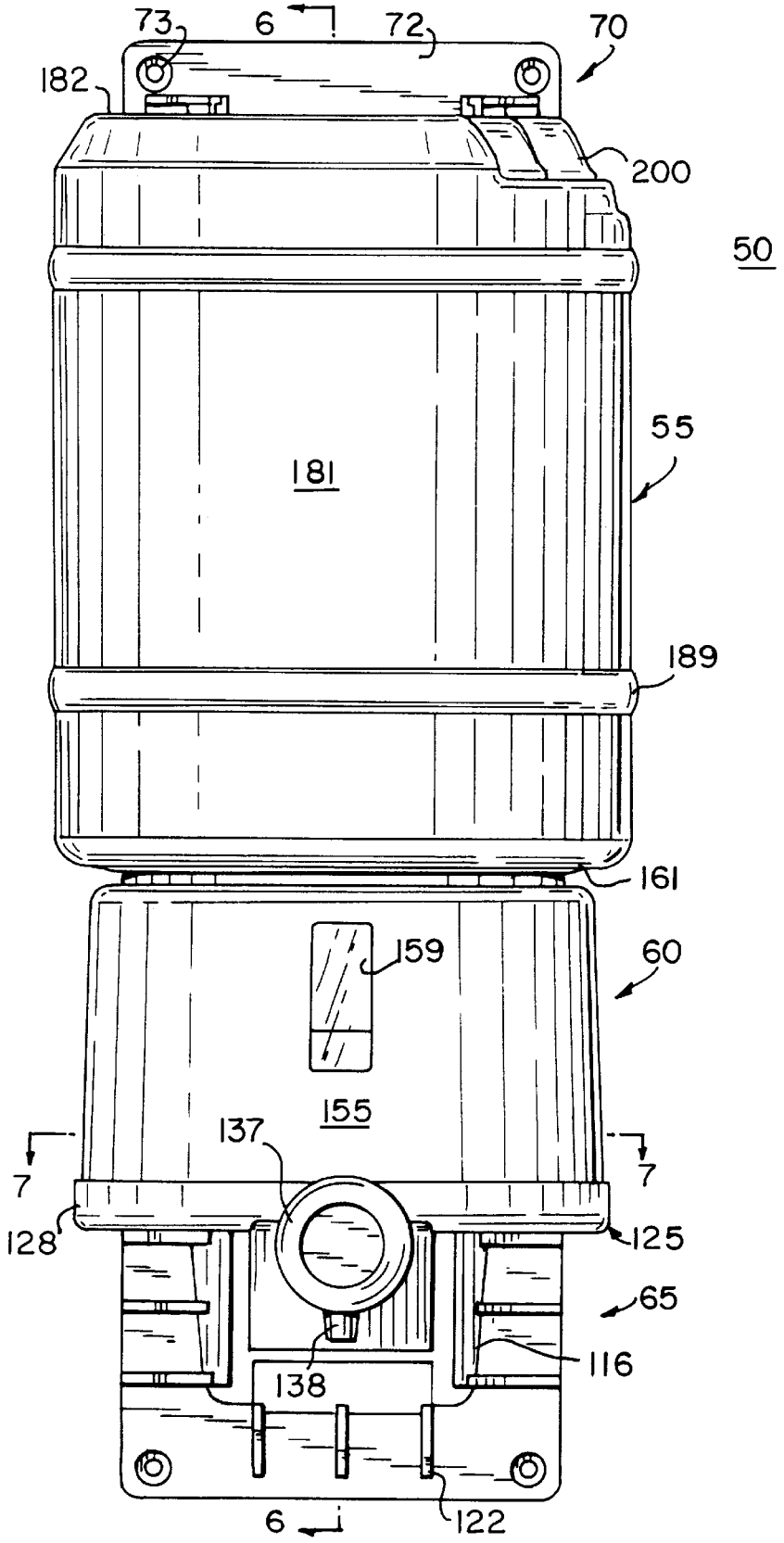
FIG. 2 is a front elevational view of the soap dispensing system illustrated in FIG. 1.
Figure 3:
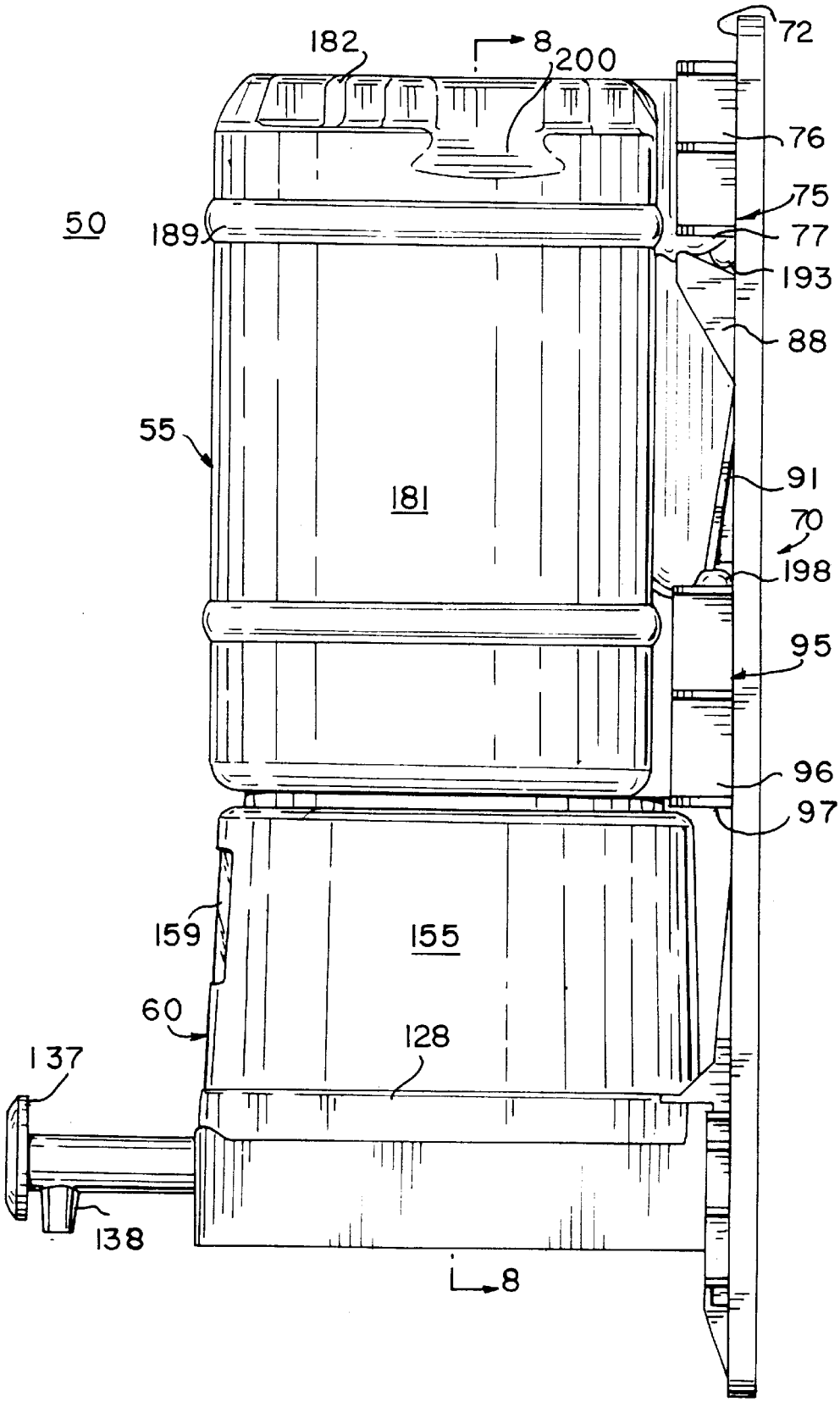
FIG. 3 is a side elevational view of the soap dispensing system illustrated in FIG.1.

On the back of the bottle are axially aligned and longitudinally spaced apart dove tail members 190 and 195. The upper dove tail member 190 is configured to fit as a tongue and groove fit into the upper mounting rails 75 and the lower dove tail member 195 is spaced to fit into the lower mounting rails 95. The upper dove tail member 190 includes a back wall 191 and spaced side walls 192 extending rearwardly of the container or bottle 55. A protrudence 193 extends downwardly from the rearward and bottom portion of the upper dove tail member 190. Similarly, the lower dove tail member 196 has a back wall, opposed side walls 197 and a protrudence 197 which extends upwardly toward the protrudence 198. On one embodiment of he bottle 55 as illustrated in FIGS. 1, 2, and 3, there is irregularly shaped notch 200 cut out of the top 182 serving as a proprietary configuration.

Figure 16:
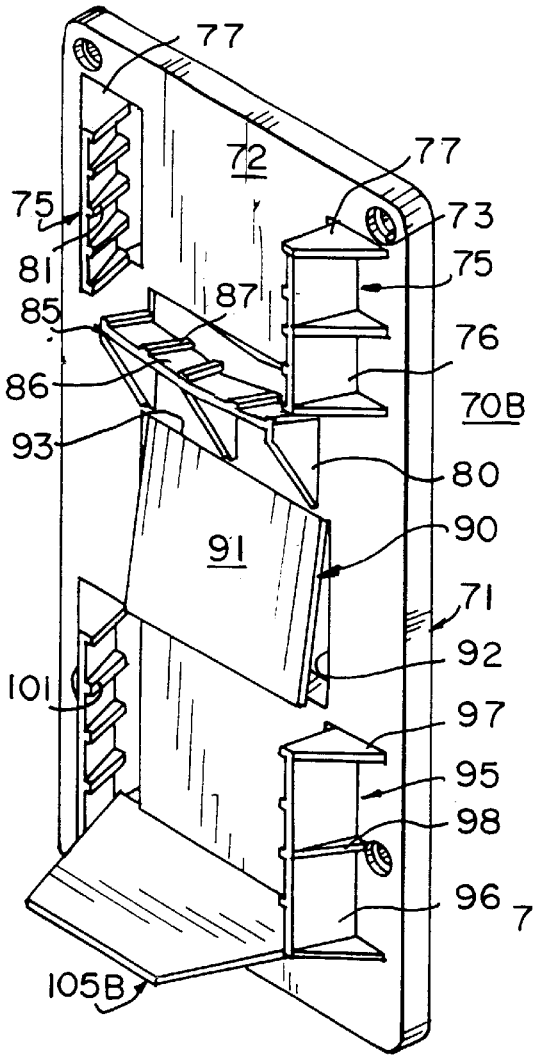
FIG. 16 is a perspective view of an alternate support plate.

As best seen in FIGS. 16 and 17, there is an intermediate sized plate 70B on which like numbers are used to identify like parts. An inspection of plate 70B and comparison with plate 70 illustrated for instance in FIGS. 1–5, shows that plate 70B is the same as the upper portion of the plate 70 to and including a point just below the second or lower pair of mounting rails 95 but does not includes a lower shelf. The lower shelf in the embodiment of plate 70B is somewhat differently shaped than the shelf in the embodiment 70 and is identified as 105B because it is trapezoidal in shape and has a longer perpendicular extent than does the arcuately shaped. The purpose of this will hereinafter be set forth.

Figure 18:
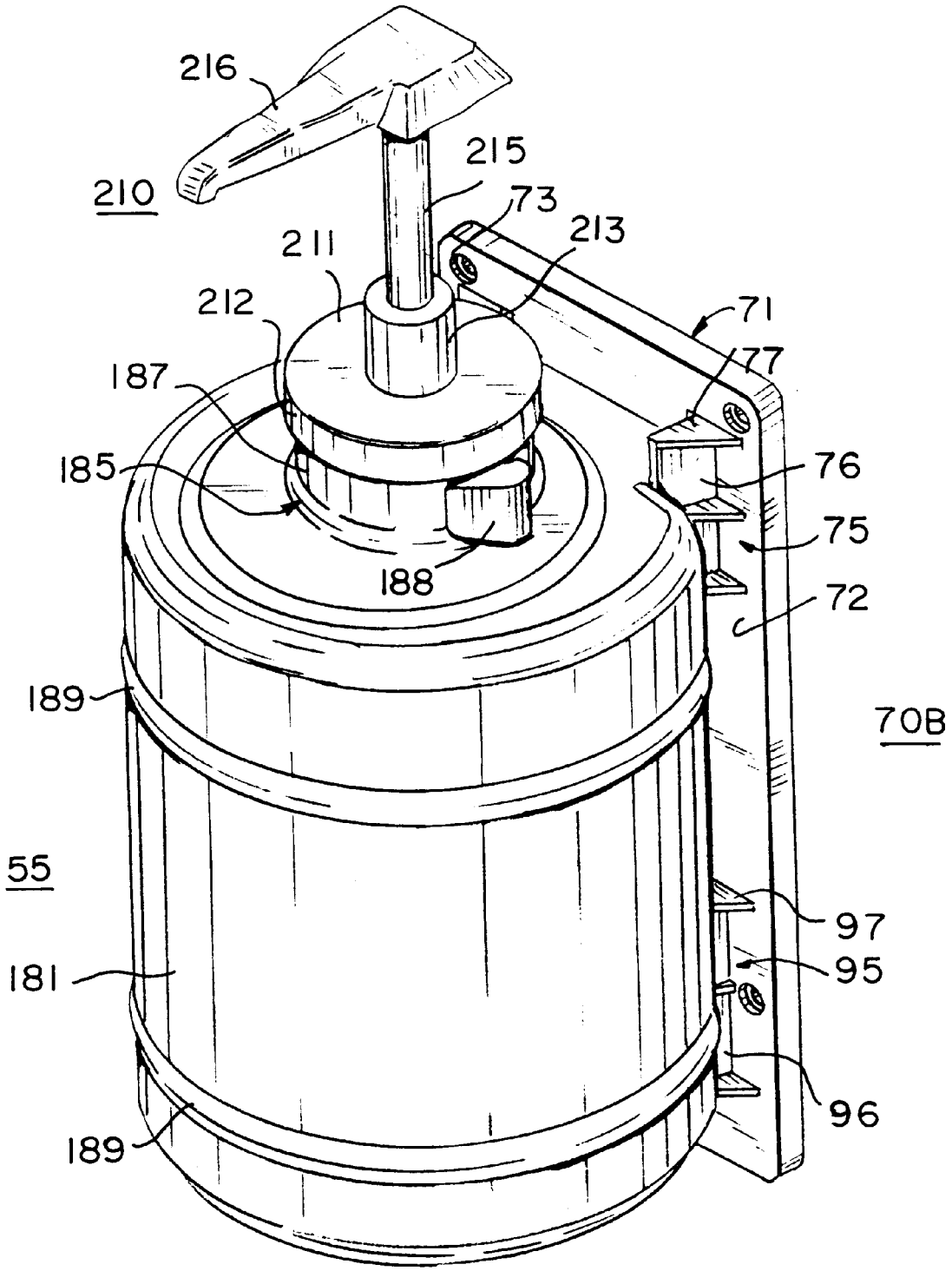
FIG. 18 is a perspective view of alternate embodiment of a soap dispenser mounted on the plate illustrated in FIG. 16.

Referring now to FIGS. 18–20, there is disclosed an embodiment 210 which is a combination of the plate 70B, the soap bottle 55 and a dispensing mechanism as well known in the art and is akin to that used on condiments such as mustard jars in restaurants and the like. The mounting plate 70B was previously described as was the soap container 55 on which like numbers have been applied to like parts. The soap container 55 slides into the upper and lower mounting rails 75 and 95, respectively, as previously described and the latch mechanism 90, as seen in FIG. 19, contacts the top of protrudence 198 and serves to maintain the soap container or bottle 55 in place preventing removal by the users of these dispensers in commercial and industrial locations. The embodiment 210 includes a circular cap 211 having an internally threaded portion 212 which mates with external threads on the neck 187 of the soap container 55. A sleeve 213 extends vertically through the cap 211 and receives a tube 215 which extends into the soap bottle 55 and the soap 220 disposed therein and can create a suction in the usual manner to dispense soap through the tube 215 and out the spout 216, all in a well known manner.

A variety of features of the present invention are important. Among the most important features are the means by which the upper latch 90 contacts the protrudence on the spaced apart dove tail members 190, 195 and particularly the lower protrudence 198 so as firmly to clamp the soap bottle or container 55 onto the mounting plate 70. The lower latching mechanism 110 slips over the top of the vertical wall 132 securely to fasten the dispensing mechanism 65 which includes the actuator 135 and dispensing mechanism support plate 125 firmly to the mounting plate 70. Whether the mounting plate 70, 70B or 70C is used, the connections are substantially the same. The virtues of this system are that it is easy in the field to use, the mechanism is easy to maintain and lends itself to a variety of uses. A combination of the reservoir 60 which the soap bottle or container 55 is novel and is a significant improvement over prior art systems because of the unique C-shaped punch mechanism 170 accommodates very viscous soaps. Soaps with yield values above 120 can be dispensed with the system of the present invention and this includes soaps having viscosities in the neighborhood of 20,000 cps. Yield value is a property critical to achieving certain physical characteristics such as particles dispersed in a suspension, emulsions, foams and the like.

The most common way to measure yield value is the Brookfield yield value extrapolation method. A Brookfield RVT viscometer is used to measure the torque necessary to rotate a spindle through a liquid sample at speeds of 0.5 to 100 rpm. Multiplying the torque reading by the appropriate constant for the spindle and speed gives the apparent viscosity. Spindle speed corresponds to shear rate. Yield value is an extrapolation of measured values to a shear rate of zero.

Viscous suspensions can and will collapse. It is a common misconception that if the viscosity of a product is high enough, it can be used to suspend. Actually, a higher viscosity only slows down the rate of particle movement. Yield value is required to create a stable suspension.

Silica sand with an average particle diameter of 0.6 mm was placed in gels made from various thickener types at different concentrations. The data suggests that a critical Brookfield yield value between 90 and 124 is required to produce a stable sand suspension. In the present case, the system of the present invention has been capable of adequately dispensing samples having viscosities of 13,000 cps and a yield value of 980, viscosities of 7500 cps with a yield value of 520 and soaps with viscosities of 20,500 cps having a yield value of 1540. It is clear from the foregoing that the subject system is entirely capable of dispensing soaps having a wide range of yield values and viscosities since it is also just as clear that the system can also effectively dispense soaps having very low viscosities in the 1000 –2000 range.

While there has been disclosed what is considered to be the preferred embodiment of the present invention, it is understood that various changes in the details may be made without departing from the spirit, or sacrificing any of the advantages of the present invention.

We claim:

1. A mounting plate and reservoir and dispensing mechanism for use with a bottle containing liquid having a viscosity up to about 20,000 cps, said mounting plate having a generally flat rectangular surface, a first pair of vertically extending mounting tracks extends outwardly of said surface, a first shelf positioned generally horizontally and extending outwardly of said surface generally below and between said first pair of tracks, a second pair of vertically extending mounting tracks extend outwardly of said surface vertically spaced below said first pair of mounting tracks, a second shelf positioned generally horizontally and extending outwardly of said surface generally below and between said second pair of tracks, a flexible first latch extending outwardly of said surface generally positioned between said first shelf and said second pair of tracks, and attachment and latch mechanism below said second shelf for supporting mechanism for dispensing liquid, a bottle having a neck at one end thereof having a membrane capable of being punctured, said bottle having a dove tail member extending longitudinally of the bottle spaced to slide between at least one of said first and second pair of mounting tracks on said mounting plate, said reservoir comprising a housing having one end for receiving the bottle of liquid and having an opening at the other end through which liquid flows, said reservoir housing having a punch extending upwardly therein and positioned to extend into the bottle neck and to puncture the membrane, said punch having a top cutting surface in the shape of a partial circle to puncture the membrane while leaving the membrane attached to the bottle, said punch having an arcuate extent of not less than about 270°, said dispensing mechanism including a plate for receiving the other end of said reservoir, said dispensing plate having an opening therein in communication with said opening in the other end of said reservoir, an actuator mounted to said dispensing plate and in communication with the other end of said reservoir for dispensing discrete doses of liquid from said reservoir upon manual actuation of said actuator, and a locking mechanism for snugly connecting said reservoir and said dispensing mechanism.

2. The apparatus of claim 1, wherein said mounting plate has a plurality of mounting apertures therein.

3. The apparatus of claim 1, wherein said first pair of vertically extending mounting tracks incline inwardly toward each other.

4. The apparatus of claim 1, wherein said first shelf has two outer ends, each end positioned adjacent an associated one of said first mounting tracks, said first shelf extending downwardly from each outer end toward the middle of said first shelf.

5. The apparatus of claim 1, wherein each of said first pair of mounting tracks and said first shelf has reenforcing ribs molded thereto.

6. The apparatus of claim 4, wherein said second shelf has a distal edge away from said plate and arcuate in shape.

7. The apparatus of claim 1, wherein said flexible latch is integral with said plate.

8. The apparatus of claim 1, wherein said plate with said first and second pairs of mounting tracks, said first and second shelves, said latch and said attachment and latch mechanism is a single piece of plastic.

9. The apparatus of claim 1, wherein said bottle has two longitudinally spaced apart dove tail members so as to slide between said first and second pair of mounting tracks on said plate when said bottle is mounted on said plate.

10. The apparatus of claim 9, wherein said first and second dove tail members respectfully contact said first and second shelves when said bottle is mounted on said plate.

11. The apparatus of claim 10, wherein said first latch extends over one of said dove tail members when said bottle is mounted on said plate to lock said bottle to said plate.

12. The apparatus of claim 1, wherein said reservoir housing is frustoconical with top and bottom flat circular surfaces, the top surface having a smaller diameter than the bottom surface, said top surface having a generally circular opening therein, said punch top cutting surface having serrated teeth and being positioned below said top surface and having the serrated teeth extending toward the top surface.

13. The apparatus of claim 12, wherein said reservoir further includes a skirt extending downwardly from said top surface and being generally concentric with said punch.

14. The apparatus of claim 13, wherein said reservoir skirt is generally cylindrical and has a plurality of portions removed therefrom to facilitate flow.

15. The apparatus of claim 14, wherein the serrated teeth extend arcuately about 295°.

16. The apparatus of claim 15, wherein said attachment and latch mechanism latches said dispensing mechanism to said mounting plate.

* * * * *